US009834358B2

(12) United States Patent
Matsuo

(10) Patent No.: US 9,834,358 B2
(45) Date of Patent: Dec. 5, 2017

(54) PRESSURE REDUCTION-ABSORBING BOTTLE

(71) Applicant: Yoshinori Matsuo, Tokyo (JP)

(72) Inventor: Yoshinori Matsuo, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/908,059

(22) PCT Filed: Jul. 10, 2014

(86) PCT No.: PCT/JP2014/068437
§ 371 (c)(1),
(2) Date: Jan. 27, 2016

(87) PCT Pub. No.: WO2015/016030
PCT Pub. Date: Feb. 5, 2015

(65) Prior Publication Data

US 2016/0176604 A1 Jun. 23, 2016

(30) Foreign Application Priority Data

Jul. 31, 2013 (JP) ..... 2013-159077

(51) Int. Cl.
*B65D 90/02* (2006.01)
*B65D 79/00* (2006.01)
*B65D 1/02* (2006.01)

(52) U.S. Cl.
CPC ..... *B65D 79/005* (2013.01); *B65D 1/0223* (2013.01); *B65D 1/0276* (2013.01); *B65D 2501/0027* (2013.01)

(58) Field of Classification Search
CPC ... B65D 79/005; B65D 1/0276; B65D 1/0223
(Continued)

(56) References Cited

U.S. PATENT DOCUMENTS 5,178,289 A 1/1993 Krishnakumar et al.
2003/0196926 A1* 10/2003 Tobias ..... B65D 1/0284 206/509

(Continued)

FOREIGN PATENT DOCUMENTS

EP 1378454 A1 1/2004
JP H07-10147 A 1/1995

(Continued)

OTHER PUBLICATIONS

Nov. 30, 2016 Search Report issued in European Patent Application No. 14831647.4.

(Continued)

*Primary Examiner* — Shawn M Braden
(74) *Attorney, Agent, or Firm* — Oliff PLC

(57) ABSTRACT

Pressure reduction-absorbing bottle includes: cylindrical shoulder portion; cylindrical body portion connecting to the shoulder portion lower end; and bottom portion formed in cylindrical shape with bottom and connecting to the body portion lower end. The bottom portion includes: heel portion connected to the body portion lower opening section, and bottom wall portion closing the heel portion lower opening section. The bottom wall portion includes: grounding portion, rising circumferential wall portion, movable wall portion, and recessed circumferential wall portion. The movable wall portion capable of rotating around the connection portion with the rising circumferential wall portion to move the recessed circumferential wall portion in up-and-down direction. The body portion includes straight cylindrical part connecting to the shoulder portion lower end and extending downward. The straight cylindrical part outer diameter is greater than or equal to 0.60 times the heel portion outer diameter and is smaller than the heel portion outer diameter.

8 Claims, 4 Drawing Sheets

(58) Field of Classification Search
USPC ..... 215/373
See application file for complete search history.

(56) References Cited

U.S. PATENT DOCUMENTS

| | | | | |
|---|---|---|---|---|
| 2006/0157439 | A1* | 7/2006 | Howell | B65D 1/0223 215/384 |
| 2006/0186082 | A1 | 8/2006 | Gatewood et al. | |
| 2009/0159556 | A1* | 6/2009 | Patcheak | B65D 1/0276 215/373 |
| 2009/0261058 | A1 | 10/2009 | Pritchett, Jr. | |
| 2011/0233166 | A1 | 9/2011 | Hiromichi et al. | |
| 2012/0037645 | A1* | 2/2012 | Boukobza | B65D 79/005 220/600 |
| 2012/0111824 | A1* | 5/2012 | Ungrady | B65D 1/0223 215/381 |
| 2014/0034659 | A1 | 2/2014 | Nakayama | |
| 2015/0041426 | A1* | 2/2015 | Oguchi | B65D 1/0223 215/382 |

FOREIGN PATENT DOCUMENTS

| | | | |
|---|---|---|---|
| JP | 2004-035110 | A | 2/2004 |
| JP | 2010-105718 | A | 5/2010 |
| JP | 2010-149895 | A | 7/2010 |
| JP | 2011-073756 | A | 4/2011 |
| JP | 2011-230823 | A | 11/2011 |
| WO | 2006/118584 | A1 | 11/2006 |
| WO | 2007/137254 | A2 | 11/2007 |
| WO | 2010/061758 | A1 | 6/2010 |
| WO | 2010/132190 | A1 | 11/2010 |
| WO | 2012/147885 | A1 | 11/2012 |
| WO | 2013/129480 | A1 | 9/2013 |

OTHER PUBLICATIONS

Oct. 7, 2014 International Search Report issued in International Patent Application No. PCT/JP2014/068437.
Feb. 14, 2017 Office Action issued in Japanese Patent Application No. 2013-159077.
Aug. 8, 2017 Office Action issued in Japanese Patent Application No. 2013-159077.

* cited by examiner

PRESSURE REDUCTION-ABSORBING BOTTLE

TECHNICAL FIELD

The present invention relates to a pressure reduction-absorbing bottle.

Priority is claimed on Japanese Patent Application No. 2013-159077, filed Jul. 31, 2013, the content of which is incorporated herein by reference.

BACKGROUND ART

In the related art, a bottle is proposed which is formed of a synthetic resin material and into a cylindrical shape with a bottom (for example, refer to Patent Document 1). A bottom wall portion of a bottom portion of the bottle includes a grounding portion positioned at the outer circumferential edge of the bottom wall portion, a rising circumferential wall portion connecting to the inner side in the radial direction of the grounding portion and extending upward, an annular movable wall portion extending inward in the radial direction of the bottle from the upper end of the rising circumferential wall portion, and a recessed circumferential wall portion extending upward from the inner end in the radial direction of the movable wall portion. In addition, the movable wall portion rotates around the connection portion between the rising circumferential wall portion and the movable wall portion so as to move the recessed circumferential wall portion upward, and thereby pressure reduction inside the bottle can be absorbed.

In such a bottle, the body portion thereof may be formed having a smaller diameter than that of the bottom portion, for example, in order to improve the external appearance quality or attractiveness thereof, or in order to easily grasp the body portion.

DOCUMENT OF RELATED ART

Patent Document

[Patent Document 1] PCT International Publication No. WO 2010/061758

SUMMARY OF INVENTION

Technical Problem

However, if the body portion of a bottle in the related art is formed having a small diameter, the volume of the body portion of the bottle decreases, and thus it is possible that pressure reduction absorption inside the bottle is not efficiently performed.

The present invention has been made in view of the above problems, and an object thereof is to provide a bottle in which a body portion is formed having a smaller diameter than that of a heel portion (a bottom portion) while appropriate pressure reduction-absorbing performance inside the bottle is maintained.

Solution to Problem

The present invention adopts the following means in order to solve the above problems. That is, a first aspect of the present invention is a pressure reduction-absorbing bottle including: a cylindrical shoulder portion; a cylindrical body portion connecting to a lower end of the shoulder portion; and a bottom portion formed in a cylindrical shape with a bottom and connecting to a lower end of the body portion. The bottom portion includes: a heel portion, an upper opening section of the heel portion being connected to a lower opening section of the body portion, and a bottom wall portion closing a lower opening section of the heel portion. The bottom wall portion includes: a grounding portion positioned at an outer circumferential edge of the bottom wall portion, a rising circumferential wall portion connecting to an inner side in a radial direction of the grounding portion and extending upward, an annular movable wall portion extending inward in the radial direction from an upper end of the rising circumferential wall portion, and a recessed circumferential wall portion extending upward from an inner end in the radial direction of the movable wall portion. The movable wall portion is arranged to be capable of rotating around a connection portion between the rising circumferential wall portion and the movable wall portion so as to move the recessed circumferential wall portion in an up-and-down direction. The body portion includes a straight cylindrical part connecting to the lower end of the shoulder portion and extending downward. The outer diameter of the straight cylindrical part is greater than or equal to 0.60 times the outer diameter of the heel portion and is smaller than the outer diameter of the heel portion.

In this case, the outer diameter of the straight cylindrical part is set to be smaller than the outer diameter of the heel portion, and thereby the external appearance of the bottle can be improved. In addition, the center of gravity of the bottle is lowered, and thus the bottle can independently and stably stand. Furthermore, the outer diameter of the straight cylindrical part is set to be greater than or equal to 0.60 times the outer diameter of the heel portion, and thereby the body portion of the bottle can secure a sufficient volume, appropriate pressure reduction-absorbing performance inside the bottle can be maintained, and thus pressure reduction absorption inside the bottle can be stably performed. Therefore, the external appearance of the bottle can be improved while appropriate pressure reduction-absorbing performance inside the bottle is maintained.

A second aspect of the present invention is that in the pressure reduction-absorbing bottle of the first aspect, the body portion is provided with two or more panel portions at intervals in a circumferential direction of the body portion, the panel portions being depressed inward in a radial direction of the body portion, and a pillar portion being formed between panel portions next to each other in the circumferential direction. The panel portion includes a panel bottom wall positioned at the inside of the panel portion in the radial direction, and a sidewall extending outward in the radial direction from an outer circumferential edge of the panel bottom wall. The panel bottom wall is provided with a rib formed between vertical sidewall parts of the sidewall intersecting with the circumferential direction, the rib projecting outward in the radial direction, and a gap being formed between the rib and each of the vertical sidewall parts.

In the second aspect of the present invention, the rigidity of the body portion increases by providing the panel portions in the body portion. Therefore, the movable wall portion can easily moves the recessed circumferential wall portion upward, and both of the body portion and the bottom portion can absorb pressure reduction.

Since the rib is arranged in the panel bottom wall, the inner side in the radial direction of a label attached covering the panel portions can be supported thereby. Accordingly, at the time the label is attached thereto, the label covering the body portion can be prevented from moving inward in the radial direction of the bottle, and can be maintained to be flat. That is, the label can be held along a circumferential line in the circumferential direction of the bottle. Therefore, creases occurring in the label due to the label being depressed inside a space (the space between a pair of vertical sidewall parts facing each other) can be limited, and deterioration of the external appearance quality of the label can be limited.

Since two or more panel portions are formed in the circumferential direction, four or more gaps in the circumferential direction are formed between ribs and vertical sidewall parts. Therefore, the body portion can deform to decrease the diameter thereof while the above gap is narrowed in the circumferential direction, sufficient pressure reduction-absorbing performance is not applied only to the bottom portion but can also be applied to the body portion. As a result, occurrence of corners in the body portion due to deformation of the body portion caused by compression during pressure reduction inside the bottle can be limited, and a favorable external appearance of the label can be reliably kept.

A third aspect of the present invention is that in the pressure reduction-absorbing bottle of the second aspect, the rib is formed on the entire length of the panel bottom wall in a bottle axis direction.

In the third aspect of the present invention, since the rib is formed on the entire range in the up-and-down direction of the panel bottom wall, the rib is connected to areas within the body portion other than areas in which the panel portions are provided. Thus, in the section in which the label and the rib overlap with each other when being seen in the radial direction, the entire range of the label in the up-and-down direction can be supported. Therefore, creases occurring in the label can be reliably prevented. Furthermore, a wide support area of the body portion for the label can be formed by the ribs and the pillar portions, and deterioration of the external appearance quality of the label can be reliably prevented.

A fourth aspect of the present invention is that in the pressure reduction-absorbing bottle of the second or third aspect, an outer surface of a top wall of the rib is positioned on an edge of an imaginary circle in a horizontal cross section of the body portion parallel to the radial direction, the imaginary circle being formed by connecting outer surfaces of top parts of a plurality of pillar portions in the circumferential direction, and the top parts being positioned at the outside of the pillar portions in the radial direction.

In the fourth aspect of the present invention, the outer surface of the top wall of the rib is positioned on the edge of the imaginary circle formed by connecting the outer surfaces of the top parts of the plurality of pillar portions in the circumferential direction, the top parts being positioned at the outside of the pillar portions in the radial direction. Therefore, the label can be reliably held along the imaginary circle. Thus, a smooth circumferential surface of the label can be formed in the circumferential direction of the bottle.

A fifth aspect of the present invention is that in the pressure reduction-absorbing bottle of any one of the first to fourth aspects, the body portion includes a lower body part extending downward from a lower end of the straight cylindrical part and connecting to an upper end of the heel portion, and the outer diameter of the lower body part gradually increases downward.

In the fifth aspect of the present invention, since the outer diameter of the lower body part connecting the straight cylindrical part and the heel portion gradually increases downward, the external appearance of the body portion can be further enhanced, and the blow moldability of the body portion can be improved. In addition, since the lower body part smoothly connects the straight cylindrical part and the heel portion which have different outer diameters, a user can easily grasp the body portion, and creases occurring in a label attached to the straight cylindrical part can be further reliably prevented.

Effects of Invention

According to a bottle of the present invention, the outer diameter of the straight cylindrical part is set to be smaller than the outer diameter of the heel portion, and thereby the external appearance and self-standing stability of the bottle are improved. In addition, the outer diameter of the straight cylindrical part is set to be greater than or equal to 0.60 times the outer diameter of the heel portion, and thereby appropriate pressure reduction-absorbing performance inside the bottle can be maintained, and the pressure reduction absorption of the bottle can be stably performed.

DESCRIPTION OF EMBODIMENTS

Hereinafter, an embodiment of a bottle of the present invention is described with reference to the drawings. In each drawing used for the following description, the scale of each member is appropriately adjusted in order to show each member in a recognizable size.

Figure 1:
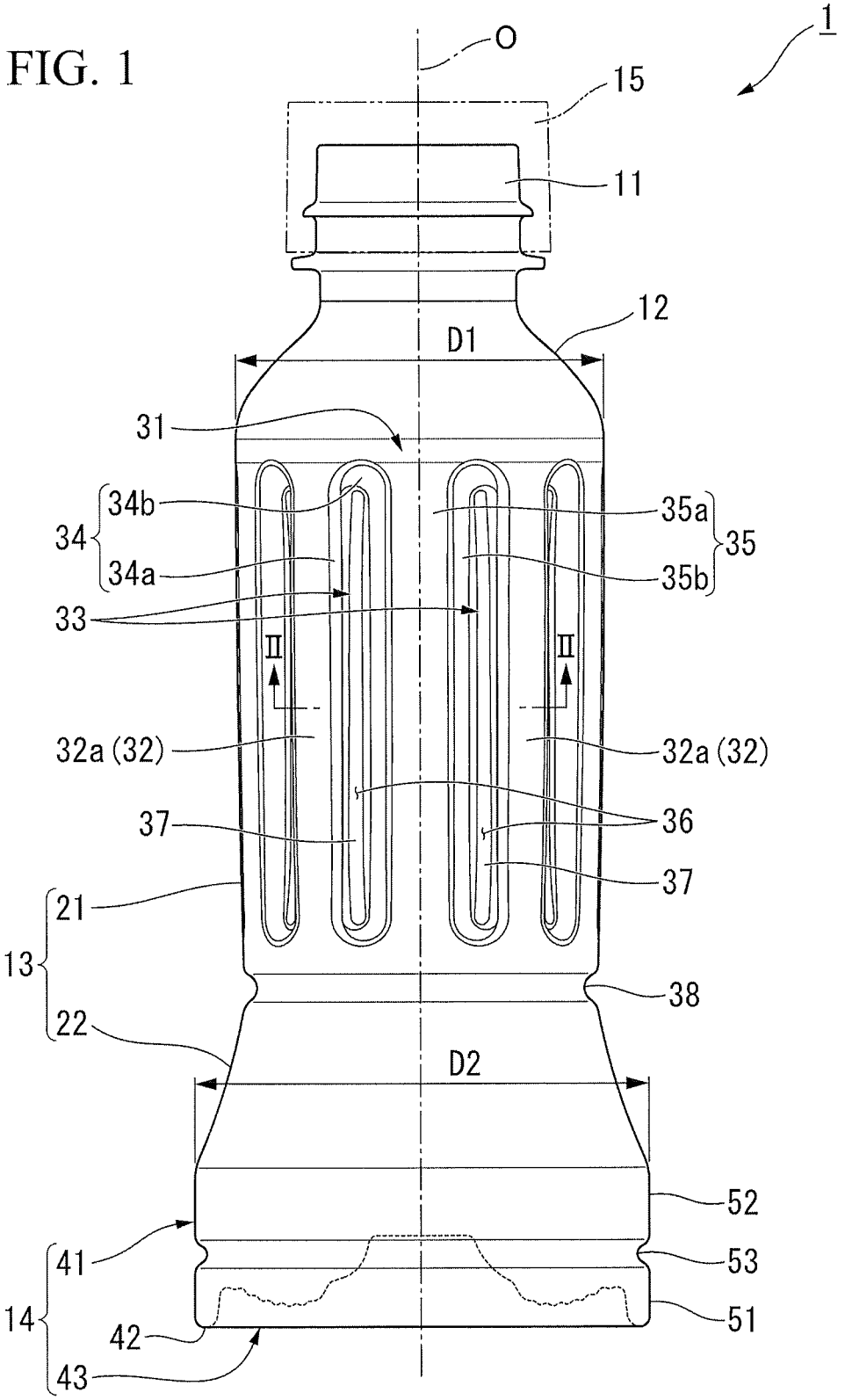
FIG. 1 is a side view showing a bottle of an embodiment of the present invention.

As shown in FIG. 1, a bottle 1 (a pressure reduction-absorbing bottle) of this embodiment includes a cylindrical mouth portion 11, a cylindrical shoulder portion 12, a cylindrical body portion 13, and a bottom portion 14 formed in a cylindrical shape with a bottom. The mouth portion 11, the shoulder portion 12, the body portion 13 and the bottom portion 14 are schematically configured to be connected together in this order in a state where the central axes thereof are positioned coaxially with a common axis. Hereinafter, the common axis is referred to as a bottle axis O, in FIG. 1, a side of the bottle close to the mouth portion 11 in a direction parallel to the bottle axis O is referred to as an upper side, another side thereof close to the bottom portion 14 in the direction is referred to as a lower side, a direction orthogonal to the bottle axis O is referred to as a radial direction, and another direction around the bottle axis O is referred to as a circumferential direction.

The bottle 1 is integrally formed of a synthetic resin material, and is formed by blow-molding (for example, biaxial stretch blow molding) a preform formed in a cylindrical shape with a bottom through injection molding. The internal capacity of the bottle 1 of this embodiment is set to be, for example, 150 to 1000 ml.

The mouth portion 11 is attached with a cap 15.

The shoulder portion 12 connects to the lower end of the mouth portion 11 and extends downward. The outer diameter of the shoulder portion 12 gradually increases downward.

The body portion 13 connects to the lower end of the shoulder portion 12 and extends downward. The body portion 13 includes a straight cylindrical part 21 connecting to the lower end of the shoulder portion and extending downward, and a lower body part 22 formed in a truncated conical cylindrical shape, connecting to the lower end of the straight cylindrical part 21, and extending downward.

The outer diameter of the straight cylindrical part 21 is a nearly fixed value on the entire length thereof in the up-and-down direction. The straight cylindrical part 21 is wound with a label (not shown) such as a shrink label. The shrink label is formed in a cylindrical shape of a heat-shrinkable resin film or the like, and is brought into close contact with the outer surface of the straight cylindrical part 21 by heat-shrinking the label. Accordingly, in order to prevent creases or the like on the shrink label after attachment, the inner side in the radial direction of the label has to be appropriately supported by the bottle.

Figure 2:
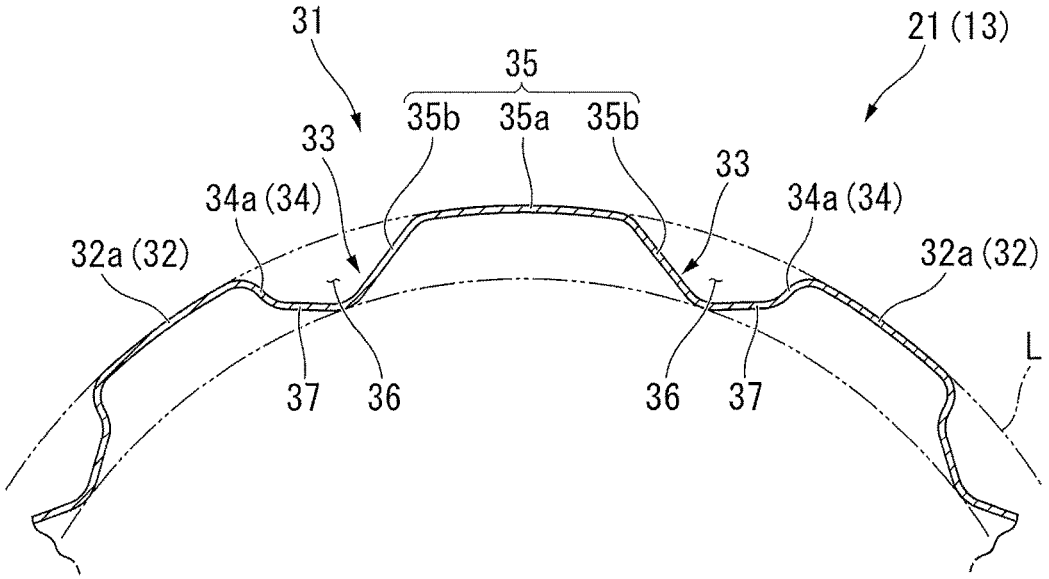
FIG. 2 is a cross-sectional view taken along II-II line in FIG. 1.

As shown FIGS. 1 and 2, the straight cylindrical part 21 is provided with a plurality of panel portions 31 (five panel portions in this embodiment) at intervals in the circumferential direction, and the panel portions 31 are depressed inward in the radial direction of the bottle and are used for pressure reduction absorption. Part of the straight cylindrical part 21 positioned between panel portions 31 next to each other in the circumferential direction forms a pillar portion 32 extending in the up-and-down direction. That is, the panel portions 31 and the pillar portions 32 are alternately arranged in the circumferential direction in the straight cylindrical part 21. The panel portions 31 extend in the up-and-down direction within an area other than two end parts in the up-and-down direction of the straight cylindrical part 21.

The panel portion 31 is formed of a panel bottom wall 33 and a sidewall 34. The panel bottom wall 33 is positioned on the inside in the radial direction of an outer circumferential surface (for example, a top part 32*a* of the pillar portion 32 described later) of the body portion 13, and the sidewall 34 extends outward in the radial direction from the outer circumferential edge of the panel bottom wall 33.

A pair of vertical sidewall parts 34*a* within the sidewall 34 connect to two ends in the circumferential direction of the panel bottom wall 33, and extend in the up-and-down direction (that is, the vertical sidewall parts 34*a* intersect with the circumferential direction of the bottle). As shown in FIG. 2, the pair of vertical sidewall parts 34*a* incline so that the separation between the pair of vertical sidewall parts 34*a* of one panel portion 31 facing each other gradually increases from the inside to the outside in the radial direction of the bottle. In addition, the vertical sidewall part 34*a* may not incline but may be configured to extend in the radial direction. The pillar portion 32 positioned between vertical sidewall parts 34*a* of panel portions 31 next to each other in the circumferential direction is formed in a rectangular shape or in a trapezoid shape in a horizontal cross section orthogonal to the bottle axis O. The top part 32*a* positioned on the outside in the radial direction of the pillar portion 32 is formed having a curved surface projecting outward in the radial direction, and the straight cylindrical part 21 has the maximum outer diameter at the top parts 32*a*.

A pair of horizontal sidewall parts 34*b* are positioned at two ends in the up-and-down direction of the sidewall 34 and extend in the circumferential direction. The pair of horizontal sidewall parts 34*b* are inclined surfaces which incline so that the separation between the pair of horizontal sidewall parts 34*b* gradually increases from the inside to the outside in the radial direction of the bottle.

As shown in FIGS. 1 and 2, a central part in the circumferential direction of the panel bottom wall 33 is provided with a vertical rib (a rib) 35 projecting outward in the radial direction of the bottle. The vertical rib 35 is arranged between a pair of vertical sidewall parts 34*a* included in one panel portion 31, a gap 36 is formed between the vertical rib 35 and each of the pair of vertical sidewall part 34*a* in the circumferential direction, and the vertical rib 35 is formed on the entire length in the up-and-down direction of the panel bottom wall 33. That is, the vertical rib 35 is connected to two ends in the up-and-down direction of the straight cylindrical part 21. Thus, in the central part in the circumferential direction of the panel portion 31, the vertical rib 35 bridges a pair of horizontal sidewall parts 34*b* facing each other in the up-and-down direction, and areas positioned on two sides in the circumferential direction of the vertical rib 35 are configured as a pair of gaps 36 extending in the up-and-down direction. In this case, the gaps 36 are positioned between outer ends in the circumferential direction of the panel portion 31 and outer ends in the circumferential direction of the vertical rib 35, and thus two gaps 36 are provided in each panel portion 31. Accordingly, since five panel portions 31 are provided in the straight cylindrical part 21 in this embodiment, a total of ten gaps 36 are arranged at intervals in the circumferential direction.

Although the vertical rib 35 of this embodiment is formed on the entire length in the up-and-down direction of the panel bottom wall 33, the present invention is not limited to this configuration, and a gap may be formed between the vertical rib 35 and the horizontal sidewall part 34*b*. That is, the vertical rib 35 extending in the up-and-down direction may not be connected to two ends in the up-and-down direction of the straight cylindrical part 21.

The vertical rib 35 is formed of a top wall 35*a* positioned on the outside in the radial direction of the panel bottom wall 33, and circumferential end walls 35*b* connecting outer ends in the circumferential direction of the top wall 35*a* to the panel bottom wall 33.

As shown in FIG. 2, in a horizontal cross section parallel to the radial direction, the top wall 35*a* is formed having a curved surface projecting outward in the radial direction. The top walls 35*a* are substantially positioned on the edge of an imaginary circle L (on the circumference of the imaginary circle L), the edge of the imaginary circle L extending in the circumferential direction of the bottle in accordance with the surface shape of each top part 32*a* of the plurality of pillar portions 32, and the straight cylindrical part 21 has the maximum outer diameter at the top walls 35*a*.

The present invention is not limited to this configuration, and the top wall 35*a* may be disposed at a position different from the circumference of the imaginary circle L extending in the circumferential direction of the bottle in accordance with surface shapes of the plurality of top parts 32*a*. In this case, it is preferable that the top walls 35*a* be arranged at positions in which the top walls 35*a* and the top parts 32*a* can appropriately support the inner side in the radial direction of a label (a shrink label) attached to the straight cylindrical part 21.

As shown in FIGS. 1 and 2, the circumferential end walls 35*b* are positioned at two ends in the circumferential direction of the vertical rib 35 and extend in the up-and-down direction. The circumferential end walls 35*b* incline so that the separation between the pair of circumferential end walls 35*b* gradually increases from the outside to the inside in the radial direction of the bottle. Thus, in a horizontal cross section parallel to the radial direction, the vertical rib 35 is formed in a trapezoid shape whose width in the circumferential direction gradually increases from the outside to the inside in the radial direction of the bottle.

Each of the pillar portion 32 and the vertical rib 35 is arranged to be line symmetry with respect to a center line extending in the radial direction through the center of each of the pillar portion 32 and the vertical rib 35. That is, the positions of inner ends in the radial direction of a pair of circumferential end walls 35*b* included in one vertical rib 35 are equivalent to each other in the radial direction, and the length in the radial direction of each of the pair of vertical sidewall parts 34*a* included in one pillar portion 32 is less than that of the circumferential end wall 35*b*.

A connection part 37 of the panel portion 31 connects the inner end in the radial direction of the vertical sidewall part 34*a* and the inner end in the radial direction of the circumferential end wall 35*b* to each other. Specifically, in a horizontal cross section parallel to the radial direction, a pair of connection parts 37 included in one panel portion 31 incline so that the separation between the pair of connection parts 37 gradually decreases from the outside to the inside in the radial direction of the bottle. In addition, the gap 36 is formed by the vertical sidewall part 34*a*, the horizontal sidewall parts 34*b*, the connection part 37, and the circumferential end wall 35*b*.

The vertical sidewall parts 34*a* incline so that the separation between the vertical sidewall parts 34*a* gradually increases from the inside to the outside in the radial direction of the bottle, and the connection parts 37 also incline so that the separation between the connection parts 37 gradually increases from the inside to the outside in the radial direction of the bottle. However, the inclination angles of the vertical sidewall part 34*a* and the connection part 37 are different from each other. As shown in FIG. 2, an angle formed between the vertical sidewall part 34*a* and a circumferential line extending in the circumferential direction of the bottle is set to be greater than another angle formed between the connection part 37 and the circumferential line. In other words, the end (the end close to the pillar portion 32) of the connection part 37 positioned on the outside in the radial direction of the bottle is connected to the end of the vertical sidewall part 34*a* positioned on the inside in the radial direction of the bottle via a bending part which bends from the end of the connection part 37 toward the outside in the radial direction of the bottle.

When the internal pressure of the bottle 1 is reduced, a force is added to the vertical rib 35 inward in the radial direction of the bottle, and then the force is transmitted to the connection part 37 connected to the vertical rib 35 (the circumferential end wall 35*b*). Since the connection part 37 is connected to the vertical sidewall part 34*a* via the above bending part, when the force is added thereto, the connection part 37 is moved so that an angle (the angle on the outside in the radial direction of the bottle) between the connection part 37 and the vertical sidewall part 34*a* increases. In other words, when the force is added thereto, the connection part 37 is moved so that the connection part 37 and the vertical sidewall part 34*a* are arranged in a straight line. Since the connection part 37 and the vertical sidewall part 34*a* are connected via the above bending part, the connection part 37 can easily move when a force during pressure reduction is added, and thus the vertical rib 35 supported by the connection parts 37 can be appropriately moved inward in the radial direction of the bottle. That is, the panel portion 31 can be configured as an auxiliary pressure reduction-absorbing portion next to a bottom wall portion 43 (described later, a movable wall portion 62).

Each of the inner and outer diameters of the lower body part 22 gradually increases downward, and a connection section between the lower body part 22 and the straight cylindrical part 21 is provided with a first annular groove 38 on the entire circumference of the connection section.

Figure 4:
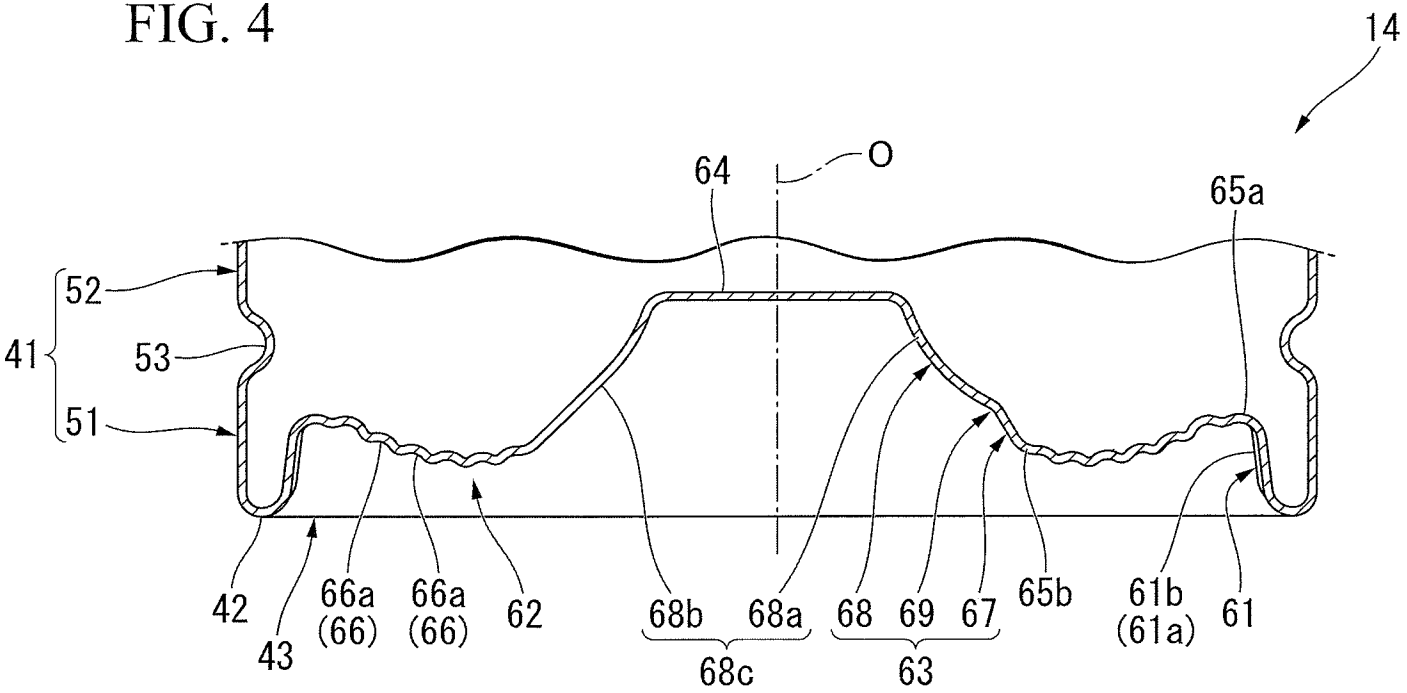
FIG. 4 is a cross-sectional view taken along IV-IV line in FIG. 3.

As shown in FIGS. 1 and 4, the bottom portion 14 includes a cylindrical heel portion 41 and the bottom wall portion 43. An upper opening section of the heel portion 41 is connected to a lower opening section of the body portion 13. The bottom wall portion 43 closes a lower opening section of the heel portion 41, and the outer circumferential edge of the bottom wall portion 43 serves as a grounding portion 42.

The heel portion 41 includes a lower heel part 51 connecting to the outer side in the radial direction of the grounding portion 42, and an upper heel part 52 connecting to the lower end of the body portion 13. In this embodiment, the outer diameter D1 of the straight cylindrical part 21 is greater than or equal to 0.60 times the outer diameter D2 of the heel portion 41 and is smaller than the outer diameter D2 of the heel portion 41.

The outer diameters of the lower and upper heel parts 51 and 52 are equivalent to each other, and the bottle 1 has the maximum outer diameter at the lower and upper heel parts 51 and 52. In addition, if the outer diameter D1 of the straight cylindrical part 21 is greater than or equal to 0.60 times the maximum outer diameter of the heel portion 41 and is smaller than the maximum outer diameter of the heel portion 41, the outer diameters of the lower and upper heel parts 51 and 52 may be different from each other. A connection section between the lower and upper heel parts 51 and 52 is provided with a second annular groove 53 on the entire circumference of the connection section.

Figure 3:
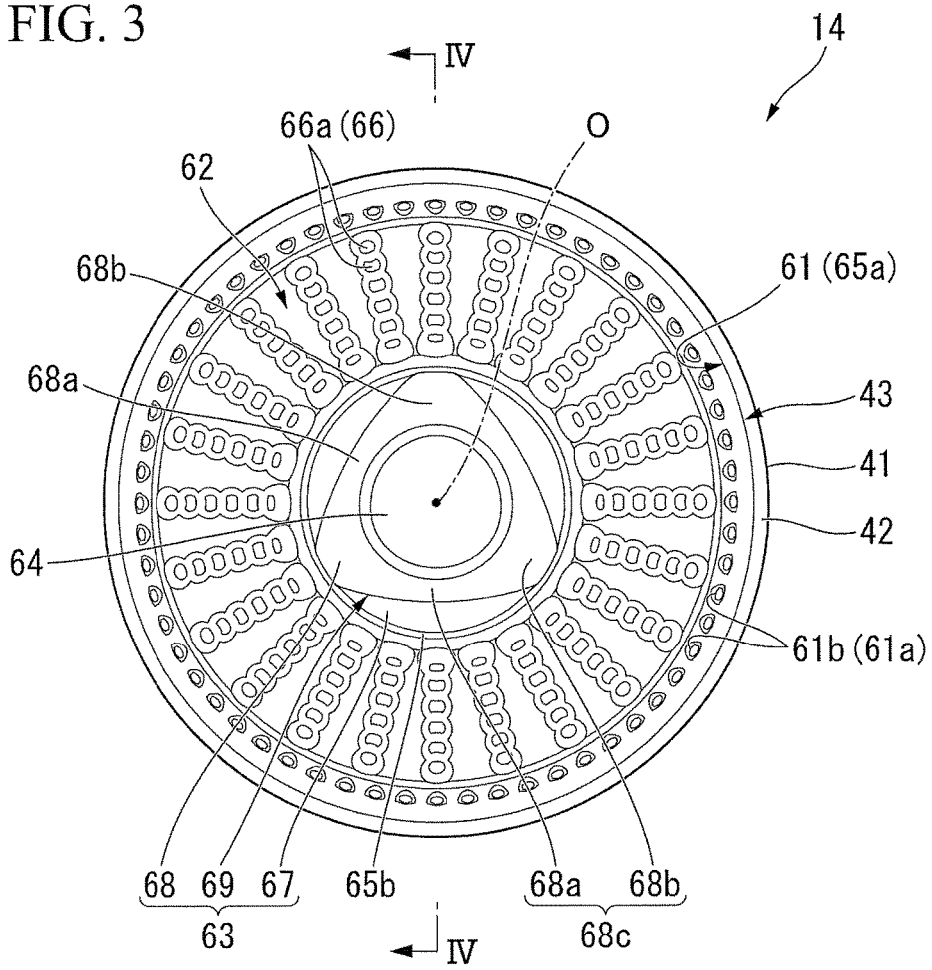
FIG. 3 is a bottom view showing the bottle of FIG. 1.

As shown in FIGS. 3 and 4, the bottom wall portion 43 includes a rising circumferential wall portion 61 connecting to the inner side in the radial direction of the grounding portion 42 and extending upward, an annular movable wall portion 62 projecting from the upper end of the rising circumferential wall portion 61 toward the center in the radial direction of the bottle, a recessed circumferential wall portion 63 extending upward from the inner end in the radial direction of the movable wall portion 62, and a top wall portion 64 connected to the upper end of the recessed circumferential wall portion 63.

As shown in FIG. 4, the rising circumferential wall portion 61 has a diameter which gradually decreases from the lower side to the upper side of the rising circumferential wall portion 61. As shown in FIGS. 3 and 4, the rising circumferential wall portion 61 is provided with an uneven portion 61*a* on the entire circumference of the rising circumferential wall portion 61. The uneven portion 61*a* includes a plurality of projections 61*b* which are arranged at intervals in the circumferential direction. The projection 61*b* projects inward in the radial direction of the bottle and is formed having a curved surface.

The movable wall portion 62 is formed having a curved surface convex downward, and extends so that the separation between the movable wall portion 62 and a plane positioned above the movable wall portion 62 and being perpendicular to the bottle axis O gradually increases from the outside to the inside in the radial direction of the movable wall portion 62. The movable wall portion 62 and the rising circumferential wall portion 61 are connected via a first curved surface part 65*a* projecting upward. The movable wall portion 62 is configured to rotate around the first curved surface part 65*a* (which is a connection portion between the rising circumferential wall portion 61 and the movable wall portion 62) so as to move the recessed circumferential wall portion 63 upward.

As shown in FIG. 3, a plurality of bottom ribs 66 are radially arranged in the movable wall portion 62 around the bottle axis O. The bottom rib 66 includes a plurality of recesses 66*a* which are arranged at intervals in the radial direction and are depressed upward to have a curved surface.

As shown in FIGS. 3 and 4, the recessed circumferential wall portion 63 is arranged coaxially with the bottle axis O, and is formed in a multi-stage cylindrical shape whose diameter gradually increases from the upper side to the lower side of the recessed circumferential wall portion 63. Specifically, the recessed circumferential wall portion 63 includes a lower cylindrical part 67 whose diameter gradually decreases upward from the inner end in the radial direction of the movable wall portion 62, an upper cylindrical part 68 whose diameter gradually increases downward from the outer circumferential edge of the top wall portion 64 and is smaller than that of the lower cylindrical part 67, and a stepped part 69 connecting the lower and upper cylindrical parts 67 and 68.

The lower cylindrical part 67 is connected to the inner end in the radial direction of the movable wall portion 62 via a second curved surface part 65*b* projecting downward. The second curved surface part 65*b* obliquely projects downward and inward in the radial direction of the bottle. The lower cylindrical part 67 is formed in a circular shape in a horizontal cross section parallel to the radial direction.

The upper cylindrical part 68 is provided with a plurality of projecting parts 68*a* at intervals in the circumferential direction, the projecting part 68*a* projecting inward in the radial direction of the bottle. In a bottom view, the projecting part 68*a* is formed having a curved surface convex outward in the radial direction of the bottle. The outer end in the radial direction of the projecting part 68*a* connects to the stepped part 69. As shown in FIG. 4, in a vertical cross section parallel to the bottle axis O direction, the projecting part 68*a* is formed having a curved surface convex inward in the radial direction of the bottle. As shown in FIG. 3, an intermediate part 68*b* positioned between projecting parts 68*a* next to each other is formed having a curved surface projecting outward in the radial direction of the bottle in a bottom view, and connects ends in the circumferential direction of projecting parts 68*a* to each other, the projecting parts 68*a* being next to each other in the circumferential direction. As shown in FIGS. 3 and 4, the projecting parts 68*a* and the intermediate parts 68*b* form a polygonal cylindrical part 68*c* having a polygonal shape (an equilateral triangle cylindrical shape) in which an intermediate part 68*b* between projecting parts 68*a* next to each other in the circumferential direction is set to be a corner (a vertex), and a projecting part 68*a* is set to be a side.

The stepped part 69 is formed having a concave curved surface depressed outward in the radial direction of the bottle. The stepped part 69 is positioned above or at an equivalent height to the upper end of the rising circumferential wall portion 61.

The top wall portion 64 is formed in a circular shape in a plan view arranged coaxially with the bottle axis O. The top wall portion 64 and the recessed circumferential wall portion 63 as a whole are formed in a cylindrical shape with a top.

When the pressure inside the bottle 1 having the above configuration reduces, in the bottom portion 14 of the bottle 1, the movable wall portion 62 rotates around the first curved surface part 65*a* which is the connection portion between the rising circumferential wall portion 61 and the movable wall portion 62, thereby moving the recessed circumferential wall portion 63 upward. In addition, the body portion 13 deforms to decrease the diameter thereof while the gap 36 between the pillar portion 32 and the vertical rib 35 is narrowed in the circumferential direction. Therefore, both of the bottom portion 14 and the body portion 13 absorb pressure reduction inside the bottle 1.

According to the bottle 1 having the above configuration, the outer diameter of the straight cylindrical part 21 is set to be greater than or equal to 0.60 times the outer diameter of the heel portion 41 and to be smaller than the outer diameter of the heel portion 41, and thus, while appropriate pressure reduction-absorbing performance inside the bottle 1 is maintained, the external appearance quality and attractiveness of the bottle 1 can be enhanced, and the self-standing stability thereof can be improved.

The rigidity of the body portion 13 can be increased by providing the panel portions 31 in the body portion 13. Accordingly, the movable wall portion 62 can easily move the recessed circumferential wall portion 63 upward, and thus pressure reduction absorption is performed at both of the body portion 13 and the bottom portion 14. In addition, since the rigidity of the body portion 13 increases, at the time of pressure reduction inside the bottle, the pressure reduction absorption can be primarily performed at the bottom portion 14, and can be secondarily performed at the body portion 13. Furthermore, since the vertical rib 35 arranged in the panel bottom wall 33 supports a label attached to the panel portion 31, the label can be held to be flat, and thus creases occurring in the label can be limited. Therefore, deterioration of the external appearance quality of the label can be reliably prevented.

Since two or more and five or less panel portions 31 are formed, sufficient pressure reduction-absorbing performance can be applied to the body portion 13, and a favorable external appearance of the label can be further reliably kept.

Since the straight cylindrical part 21 and the heel portion 41 are connected through the lower body part 22, the external appearance of the body portion 13 can be further enhanced, and the blow moldability of the body portion 13 can be improved.

The inventor of the present invention has tested how the pressure reduction-absorbing performance of the bottle 1 is changed in accordance with the ratio of the outer diameter D1 of the straight cylindrical part 21 and the outer diameter D2 of the heel portion 41.

Hereinafter, sample bottles which were used for this test are described. The shapes and thicknesses of the bottom portions 14 of all the sample bottles were the same. The outer diameters D1 of the straight cylindrical parts 21 were different between the samples 1 to 3, and the numbers of the panel portions 31 were different between the samples 1 and 4 to 6. The absorbing volume shown in the following table 1 is a value showing the volume inside a bottle immediately before the shape of the bottle cannot be maintained due to crush or bending of the bottle when the pressure inside the bottle is reduced.

TABLE 1

| | | SAMPLE 1 | SAMPLE 2 | SAMPLE 3 | SAMPLE 4 | SAMPLE 5 | SAMPLE 6 |
|---|---|---|---|---|---|---|---|
| D1 [mm] | | 46.7 | 57.5 | 35.0 | 46.7 | 46.7 | 46.7 |
| D2 [mm] | | 57.5 | 57.5 | 57.5 | 57.5 | 57.5 | 57.5 |
| D2 − D1 [mm] | | 10.8 | 0 | 22.5 | 10.8 | 10.8 | 10.8 |
| D1/D2 | | 0.81 | 1 | 0.61 | 0.81 | 0.81 | 0.81 |
| THE NUMBER OF PANEL PORTIONS | | 5 | 5 | 5 | 4 | 3 | 2 |
| ABSORBING VOLUME | TOTAL [ml] | 10.9 | 12.6 | 9.3 | 11.1 | 10.3 | 9.7 |
| | BODY PORTION [ml] | 4.9 | 6.9 | 3.0 | 4.9 | 4.2 | 3.9 |
| | BOTTOM PORTION [ml] | 6.0 | 5.7 | 6.3 | 6.2 | 6.1 | 5.8 |
| PRESSURE REDUCTION INTENSITY [kPa] | | 24.2 | 20.6 | 28.6 | 26.6 | 26.3 | 22.0 |

As shown in the table 1, in a case where the outer diameter D1 of the straight cylindrical part 21 is set to be smaller than the outer diameter D2 of the heel portion 41, although the absorbing volume becomes less than that of another case where the outer diameter D1 is set to be equivalent to the outer diameter D2 (D1/D2=1, refer to the sample 2), the pressure reduction intensity is increased.

Since the shapes and thicknesses of the bottom portions 14 of all the samples are the same, the absorbing volumes of the bottom portions 14 are nearly equivalent. However, the higher the pressure reduction intensity of the body portion 13 is, the more easily the movable wall portion 62 moves the recessed circumferential wall portion 63 upward, and thus the more the total absorbing volume of the bottle 1 is increased. In addition, since the body portion 13 is provided with the panel portions 31, the rigidity of the body portion 13 is increased, and both of the body portion 13 and the bottom portion 14 can absorb pressure reduction.

The more the outer diameter D1 of the straight cylindrical part 21 decreased, the more the absorbing volume reduced. In addition, the more the number of the panel portions 31 was decreased, the more the absorbing volume reduced. With regard to the relationship between the number of the panel portions 31 and the absorbing volume, there was no significant difference between the case of five panels and the case of four panels, but the absorbing volume reduced by 14.3% in the case of three panels, and reduced by 20.4% in the case of two panels. However, a sufficient absorbing volume was secured in each case. Although deformation slightly occurred in an upper part of the pillar portion 32 of the samples 1, 2 and 4, and slightly occurred in the lower body part 22 of the samples 3 to 5, since a sufficient absorbing volume was secured in the bottle 1, it is understood that the pressure reduction occurring inside the bottle 1 was sufficiently absorbed.

In a case where the outer diameter D1 of the straight cylindrical part 21 was less than or equal to, for example, 34.0 mm and the ratio of the outer diameter D1 of the straight cylindrical part 21 to the outer diameter D2 of the heel portion 41 was less than 0.60, the blow moldability of the bottle 1 was low.

The present invention is not limited to the above embodiment, and various modifications can be adopted within the scope of the present invention.

For example, the outer diameters of the straight cylindrical part and the heel portion may be appropriately changed as long as the ratio of the outer diameter of the straight cylindrical part to the outer diameter of the heel portion is greater than or equal to 0.60 and is less than 1.

Although the panel portion is provided in an area other than two end parts in the up-and-down direction of the body portion, the panel portion may be provided on the entire length in the up-and-down direction of the straight cylindrical part.

Although one vertical rib is arranged in the panel bottom wall, a plurality of vertical ribs may be arranged at intervals within the panel bottom wall.

Although the number of the panel portions provided in the body portion is 2 or more and 5 or less, another number may be adopted, and no panel portion may be provided therein.

The body portion may be provided with no lower body part, and may be provided with a connection part which is formed in an annular shape in a plan view and connects the lower end of the straight cylindrical part and the upper end of the heel portion to form a stepped shape. For example, the connection part is arranged to be parallel to a plane perpendicular to the bottle axis O. In addition, the outer diameter of the straight cylindrical part may not be completely a fixed value on the entire length in the up-and-down direction of the straight cylindrical part, but may gradually and slightly decrease (for example, by about 1.5 mm) downward. For example, polyethylene terephthalate, polyethylene naphthalate, non-crystalline polyester, or a blended material thereof may be appropriately used for the synthetic resin material forming the bottle.

The bottle is not configured as only a single-layer structure but may also be configured as a laminated structure including an intermediate layer. The intermediate layer includes a layer formed of a resin material having a gas barrier property, a layer formed of a recycled material, a layer formed of a resin material having oxygen absorbency, and the like.

INDUSTRIAL APPLICABILITY

The present invention can be applied to a bottle in which a body portion is formed having a smaller diameter than that of a heel portion while appropriate pressure reduction-absorbing performance inside the bottle is maintained.

DESCRIPTION OF REFERENCE SIGNS

1 bottle
11 mouth portion
12 shoulder portion
13 body portion
14 bottom portion
21 straight cylindrical part
22 lower body part

31 panel portion
32 pillar portion
32*a* top part
33 panel bottom wall
34 sidewall
34*a* vertical sidewall part
35 vertical rib (rib)
35*a* top wall
36 gap
41 heel portion
42 grounding portion
43 bottom wall portion
61 rising circumferential wall portion
62 movable wall portion
63 recessed circumferential wall portion
L imaginary circle
O bottle axis

The invention claimed is:

1. A pressure reduction-absorbing bottle, comprising:
a cylindrical shoulder portion;
a cylindrical body portion connecting to a lower end of the shoulder portion; and
a bottom portion formed in a cylindrical shape with a bottom and connecting to a lower end of the body portion;
wherein the bottom portion includes:
a heel portion, an upper opening section of the heel portion being connected to a lower opening section of the body portion, and
a bottom wall portion closing a lower opening section of the heel portion;
wherein the bottom wall portion includes:
a grounding portion positioned at an outer circumferential edge of the bottom wall portion,
a rising circumferential wall portion connecting to an inner side in a radial direction of the grounding portion and extending upward,
an annular movable wall portion extending inward in the radial direction from an upper end of the rising circumferential wall portion, and
a recessed circumferential wall portion extending upward from an inner end in the radial direction of the movable wall portion;
wherein the movable wall portion is arranged to be capable of rotating around a connection portion between the rising circumferential wall portion and the movable wall portion so as to move the recessed circumferential wall portion in an up-and-down direction;
wherein the body portion includes a straight cylindrical part connecting to the lower end of the shoulder portion and extending downward;
wherein an outer diameter of the straight cylindrical part is greater than or equal to 0.60 times an outer diameter of the heel portion and is smaller than the outer diameter of the heel portion;
wherein the body portion is provided with two or more panel portions at intervals in a circumferential direction of the body portion, the panel portions being depressed inward in a radial direction of the body portion, and a pillar portion being formed between panel portions next to each other in the circumferential direction;
wherein a panel portion includes a panel bottom wall positioned at an inside of the panel portion in the radial direction, and a sidewall extending outward in the radial direction from an outer circumferential edge of the panel bottom wall; and
wherein the panel bottom wall is provided with a rib formed between vertical sidewall parts of the sidewall intersecting with the circumferential direction, the rib projecting outward in the radial direction, and a gap being formed between the rib and each of the vertical sidewall parts.

2. The pressure reduction-absorbing bottle according to claim 1,
wherein the rib is formed on an entire length of the panel bottom wall in a bottle axis direction.

3. The pressure reduction-absorbing bottle according to claim 1,
wherein an outer surface of a top wall of the rib is positioned on an edge of an imaginary circle in a horizontal cross section of the body portion parallel to the radial direction, the imaginary circle being formed by connecting outer surfaces of top parts of a plurality of pillar portions in the circumferential direction, and the top parts being positioned at the outside of the pillar portions in the radial direction.

4. The pressure reduction-absorbing bottle according to claim 1,
wherein the body portion includes a lower body part extending downward from a lower end of the straight cylindrical part and connecting to an upper end of the heel portion, and
an outer diameter of the lower body part gradually increases downward.

5. The pressure reduction-absorbing bottle according to claim 2,
wherein an outer surface of a top wall of the rib is positioned on an edge of an imaginary circle in a horizontal cross section of the body portion parallel to the radial direction, the imaginary circle being formed by connecting outer surfaces of top parts of a plurality of pillar portions in the circumferential direction, and the top parts being positioned at the outside of the pillar portions in the radial direction.

6. The pressure reduction-absorbing bottle according to claim 2,
wherein the body portion includes a lower body part extending downward from a lower end of the straight cylindrical part and connecting to an upper end of the heel portion, and
an outer diameter of the lower body part gradually increases downward.

7. The pressure reduction-absorbing bottle according to claim 3,
wherein the body portion includes a lower body part extending downward from a lower end of the straight cylindrical part and connecting to an upper end of the heel portion, and
an outer diameter of the lower body part gradually increases downward.

8. The pressure reduction-absorbing bottle according to claim 5,
wherein the body portion includes a lower body part extending downward from a lower end of the straight cylindrical part and connecting to an upper end of the heel portion, and
an outer diameter of the lower body part gradually increases downward.

* * * * *